US007811391B2

(12) United States Patent
Matzdorf et al.

(10) Patent No.: US 7,811,391 B2
(45) Date of Patent: Oct. 12, 2010

(54) COMPOSITION AND PROCESS FOR PREPARING PROTECTIVE COATINGS ON METAL SUBSTRATES

(75) Inventors: Craig A. Matzdorf, California, MD (US); William C. Nickerson, Jr., Hughesville, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1112 days.

(21) Appl. No.: 11/116,165

(22) Filed: Apr. 21, 2005

(65) Prior Publication Data

US 2006/0237098 A1 Oct. 26, 2006

Related U.S. Application Data

(63) Continuation-in-part of application No. 11/116,166, filed on Apr. 21, 2005.

(51) Int. Cl.
*C23C 22/30* (2006.01)
*C23C 22/34* (2006.01)
*C23C 22/48* (2006.01)

(52) U.S. Cl. ..... 148/267; 148/243; 148/247; 148/264; 148/268; 148/274; 148/283; 106/14.05; 106/14.11; 106/14.13; 106/14.21

(58) Field of Classification Search ..... 148/243, 148/247, 264, 267, 268, 274, 283; 106/14.05, 106/14.11, 14.13, 14.21

See application file for complete search history.

(56) References Cited

U.S. PATENT DOCUMENTS

| | | | | |
|---|---|---|---|---|
| 4,138,353 | A * | 2/1979 | Lipinski | 252/181 |
| 4,235,838 | A * | 11/1980 | Redmore et al. | 422/7 |
| 4,273,592 | A | 6/1981 | Kelly | 148/6.27 |
| 4,719,035 | A * | 1/1988 | Palmer | 252/390 |
| 4,786,336 | A | 11/1988 | Schoener et al. | 148/6.27 |
| 4,971,635 | A * | 11/1990 | Guhde et al. | 148/267 |
| 5,064,751 | A | 11/1991 | Ohki et al. | |
| 5,091,023 | A | 2/1992 | Saeki et al. | 148/247 |
| 5,401,337 | A | 3/1995 | Carlson et al. | 148/257 |
| 5,449,415 | A | 9/1995 | Dolan | 148/259 |
| 6,669,764 | B1 | 12/2003 | Matzdorf et al. | 106/14.44 |
| 2004/0104377 | A1 | 6/2004 | Phelps et al. | |
| 2005/0126427 | A1 * | 6/2005 | Gonzalez et al. | 106/1.16 |

* cited by examiner

*Primary Examiner*—Roy King
*Assistant Examiner*—Lois Zheng
(74) *Attorney, Agent, or Firm*—Mark D. Kelly; Mark O. Glut

(57) ABSTRACT

This invention comprises an acidic aqueous solution for treating metal substrates to improve the adhesion bonding and corrosion protection of the metal surface which comprises effective amounts of water soluble trivalent chromium compounds, fluorozirconates, effective amounts of at least one corrosion inhibitors such as benzotriazole, fluorometallic compounds, zinc compounds, thickeners, surfactants, and at least about 0.001 mole per liter of the acidic solution of a polyhydroxy and/or carboxylic compound as a stabilizing agent for the aqueous solution.

2 Claims, 3 Drawing Sheets

COMPOSITION AND PROCESS FOR PREPARING PROTECTIVE COATINGS ON METAL SUBSTRATES

CONTINUATION APPLICATION

This Application is a Continuation-In-Part of copending Application Serial No. 11/116,166, Filed: Apr. 21, 2005.

ORIGIN OF INVENTION

The invention described herein was made by employee(s) of the United States Government and may be manufactured and used by or for the Government for governmental purposes without the payment of any royalties thereon or therefor.

BACKGROUND OF THE INVENTION

FIELD OF THE INVENTION

This invention relates to compositions and to a process for using said compositions for preparing protective coatings on various metal substrates. The process comprises treating the metal substrates with effective amounts of an acidic aqueous solution containing at least one trivalent chromium compound, at least one fluorozirconate, at least one carboxylic compound and/or polyhydroxy compound, at least one corrosion inhibitor, and optionally effective amounts of fluorometallic compounds such as fluorotitanates, fluorotantalates, fluoroborates, fluorosilicates, divalent zinc compounds, surfactants, wetting agents and/or thickeners. More specifically, this invention relates to stable acidic aqueous solutions and the process for treating various metal substrates including pre-coated metal substrates such as anodized aluminum to improve the metal substrates adhesion bonding and corrosion-resistant properties. The process comprises treating the metal substrates with a stable acidic aqueous solution containing effective amounts of at least one water-soluble trivalent chromium salt, at least one water soluble hexafluorozirconate, at least one water soluble poly or mono-carboxylic compound and/or polyhydroxy compound, and at least one water soluble anti-pitting or corrosion inhibitor. In addition, compounds that can be added to improve the color and stability of the acidic solutions in small but effective amounts include at least one water soluble hexa or tetra-fluorometallic compounds, divalent zinc salts, and effective amounts of water soluble thickeners and/or water soluble surfactants.

This invention comprises a range of aqueous solutions or compositions of specific chemicals and to the processes for depositing coatings derived from these chemicals onto a variety of metallic substrates including pre-existing metal coated substrates. For example, the compositions or solutions are particularly useful for coating aluminum and aluminum alloy i.e. aluminum conversion coatings to enhance corrosion protection and paint adhesion; for sealing anodic coatings to enhance corrosion protection; for treatment of titanium or titanium alloys for enhanced paint adhesion; for treatment of magnesium alloys for enhanced paint adhesion and corrosion protection; for coating steel for enhanced paint adhesion and rust inhibition; and for post-treatment of phosphate coatings, zinc, zinc-nickel, tin-zinc, and cadmium sacrificial coatings on iron alloys and other metal substrates e.g. steel for enhanced paint adhesion and corrosion protection.

Many of the current pretreatment, post-treatment and sealer solutions are based on the use of hexavalent chromium chemistry. Hexavalent chromium is highly toxic and a known carcinogen. As a result, the solutions used to deposit these coatings and the coatings per se are toxic. The hexavalent chromium films or coatings do, however, yield outstanding paint adhesion, good corrosion resistance, low electrical resistance and can be easily applied by immersion, spray or wipe-on techniques. However, the environmental laws, executive orders, and local occupational, safety, and health (OSH) regulations are driving the military and the commercial users in search for alternatives. Moreover, the use of hexavalent chromium coatings is becoming more expensive as regulations tighten and costs become prohibitive with future PEL restrictions imposed by the EPA and OSHA. In addition, certain processes like spraying chromate solutions are forbidden at some facilities due to OSH risk, forcing the use of less than optimum alternative solutions. In summary, hexavalent chromate coatings are technically outstanding, but from a life-cycle cost, environmental, and OSH perspective, alternatives are highly desirable. Accordingly, research is underway to develop alternative processes for metal finishing that are technically equivalent or superior to hexavalent chromate coatings without the environmental and health drawbacks.

Many of these alternatives, regardless of composition and methods of application, have a tendency to precipitate solid material from solution especially after heavy usage. This precipitation can, over time, weaken the effectiveness of the coating solution as the active compounds precipitate as insoluble solids. Additionally, the solid precipitations have the potential to clog filters, lines, and pumps for both the immersion and spray applications. Therefore, better compositions are needed to stabilize the acidic solutions for storage and process applications that will not interfere with the deposition process or the subsequent performance of the deposited coating.

SUMMARY OF THE INVENTION

This invention relates to compositions and processes for preparing corrosion-resistant coatings on various metallic substrates including pre-coated metal substrates such as phosphate coatings or anodized coatings which comprises treating the metal substrates with an acidic aqueous solution comprising trivalent chromium m compounds, fluorozirconates, corrosion or pitting inhibitors, e.g. triazoles, and stabilizing compounds. Optionally, one or more fluorometallic compounds, surfactants, thickeners, and divalent zinc compounds can be added to the acidic solutions. This invention can be utilized to improve the adhesion of various other coatings such as paint to the metal surface and to prevent pitting and corrosion of the metal surface such as aluminum, steel, galvanized surfaces and the like. More specifically, the acidic solutions of this invention also contains effective amounts of at least one water-soluble, corrosion-inhibiting or anti-pitting compound together with stabilizing agents consisting of polyhydroxy compounds and/or water-soluble carboxylic compounds containing one or more carboxylic functional groups having the general formula R—COO— wherein R is hydrogen or a lower molecular weight organic radical or functional group. The solution stabilizers i.e. the carboxylic compounds can be used in the form of their acids or salts. In some cases the salts of the carboxylic stabilizers perform better than their acids. For example, organic acids such as formic, acetic, glycolic, propionic, citric and other short-chain or low molecular weight carboxylic acids that naturally buffer in the mildly acidic pH range can be utilized as the solution stabilizers. The advantage of adding the polyhydroxy or carboxylic stabilizers to the acidic solution is the improved shelf-life and working stability of the solutions. The acidic solutions with the addition of the stabilizing agents had substantially no precipitation after more than twenty-four months of shelf-life evaluation and without any degradation of the as-deposited coating performance.

FIGS. 1-6 show the improved performance of an aluminum alloy coated with the triazole-containing solutions of this invention in comparison to the same coatings without the corrosion-inhibiting triazoles.

It is therefore an object of this invention to provide a stable acidic aqueous solution comprising trivalent chromium compounds, fluorozirconates, polyhydroxy compounds or carboxylic compounds and an effective amount of an inhibitor for coating metal substrates including pre-coated substrates to improve the adhesion and corrosion-resistance properties of the metal.

It is another object of this invention to provide a stable acidic aqueous solution having a pH ranging from about 1.0 to 5.5 comprising trivalent chromium compounds, fluorozirconates, anti-pitting compounds and at least one polyhydroxy compound and/or carboxylic compound for treating metal substrates with or without a pre-existing metal coating.

It is another object of this invention to provide a process for treating metal substrates to provide coatings with an identifiable color, good adhesion and improved corrosion resistance.

It is a further object of this invention to provide a stable acidic aqueous solution having a pH ranging from about 2.5 to 4.5 comprising trivalent chromium compounds, hexafluorozirconates, corrosion inhibitors and at least one carboxylic or polyhydroxy compound for treating metal substrates at ambient temperatures and higher wherein said acidic solutions contain substantially no hexavalent chromium.

These and other object of the invention will become apparent by reference to the detailed description when considered in conjunction with the accompanying FIGS. 1 to 6, (photos).

DETAILED DESCRIPTION OF THE INVENTION

Figure 1:
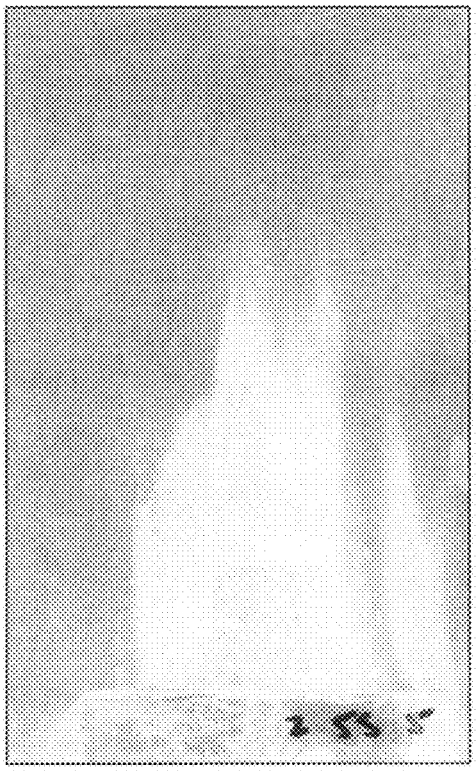
FIG. 1 (photo) shows the corrosion performance of the aluminum alloy (2024-T3) panel with a conversion coating derived from the composition of Example 1 without the triazole inhibitor.

This invention relates to stable acidic aqueous solutions and to the process of using said aqueous solutions having a pH ranging from about 1.0 to 5.5, and preferably from about 2.5 to 4.5 or 3.4 to 4.0 for preparing zirconium-chromium coatings e.g. a conversion coating on metal substrates including, for example, pre-coated substrates such as anodized aluminum or phosphate coated substrates to improve the adhesion bonding and corrosion-resistance properties of the metal. Phosphate coatings known in the art include, for example, coatings of zinc phosphate, iron phosphate, manganese phosphates and mixed calcium-zinc phosphate coatings. The process comprises using the acidic aqueous solution at temperatures ranging up to about 120° F. or higher e.g. up to about 200° F. The solutions comprise from about 0.01 to 100 grams and preferably from about 0.01 to 22 or 5.0 to 7.0 grams per liter of the acidic solution of at least one water soluble trivalent chromium compound e.g. chromium sulfate, about 0.01 to 24 grams and preferably about 1.0 to 12 or 1.0 to 6.0 grams per liter of the solution of at least one fluorozirconate e.g. an alkali metal salt of $H_2ZrF_6$, an effective amount sufficient to inhibit corrosion ranging, for example, from about 0.001 to 4.0 grams per liter and preferably about 0.25 to 2.0 grams or 0.25 to 1.0 gram per liter of a water-soluble corrosion inhibitor or anti-pitting compound such as benzotriazole, and from about 0.001 to 2.0 grams and preferably from 0.001 to 1.0 or 0.01 to 1.0 mole per liter of the solution of at least one water-soluble stabilizing agent or compound selected from the group consisting of carboxylic compounds, polyhydroxy compounds and mixtures of these stabilizing compounds in any ratio. If needed, each of the compounds of this invention can be used up to their solubility limits in the acidic aqueous solutions depending on the metal surface being treated. The metal surfaces treated in accordance with the present invention may be any metal substrate including, for example, iron, zinc, magnesium, steel surfaces including galvanized steel, aluminum and aluminum alloys. Any metal surface, including metal surfaces containing a protective or pre-existing metal coating may be treated with the compositions of the present invention.

The coatings are applied after cleaning and deoxidizing or pickling the metal substrate e.g. aluminum substrate via conventional mechanical or chemical techniques. The acidic solution of this invention is applied at about room temperature to the metal substrate via immersion, spray or wipe-on techniques similar to the process used for other metal treatments. Solution dwell time ranges from about 1.0 to 60 minutes or longer. With this solution, the 1.0 to 40 or 1.0 to 10 minute dwell time yields an optimum film for color change, paint adhesion, and corrosion resistance. The 1.0 to 10 minute dwell time yields appreciable color change to the coating depending primarily on the chemical composition of the aqueous solution. The remaining solution is subsequently rinsed from the metal substrate with tap or deionized water.

In some processes, depending on the physical characteristics of the metal substrate e.g. the physical size of the steel or aluminum substrates, the addition of a thickener to the solution aids in optimum film formation during spray and wipe-on applications by slowing down solution evaporation. This mitigates the formation of powdery deposits that degrade paint adhesion. The addition of thickeners, also aids in proper film formation during large area applications and mitigates the diluent effect of rinse water that remains on the substrate during processing from previous steps. This feature of the process yields films or coatings that have no streaks and are an improvement in both coloration and corrosion protection. Water-soluble thickeners such as the cellulose compounds can be present in the acidic aqueous solution in amounts ranging from about 0.0 to 20 grams per liter and preferably 0.5 to 10 grams e.g., about 0.1 to 5.0 grams per liter of the aqueous solution. Further, depending on the characteristics of the metal substrates, an effective but small amount of at least one water-soluble surfactant or wetting agent can be added to the acidic solution in amounts ranging from about 0.0 to 20 grams and preferably from 0.5 to 10 grams e.g. 0.1 to 5.0 grams per liter of the acidic solution. There are many water soluble surfactants known in the prior art and therefore for purpose of this invention the surfactants can be selected from the group consisting of non-ionic, cationic and anionic surfactants.

The trivalent chromium is added to the solution as a water-soluble trivalent chromium compound, either as a liquid or solid and preferably as a trivalent chromium salt. Specifically, in formulating the acidic aqueous solutions of this invention, the chromium salt can be added conveniently to the solution in its water soluble form wherein the valence of the chromium is plus 3. For example, some of the preferred chromium compounds are incorporated in the solution in the form of $Cr_2(SO_4)_3$, $(NH_4)Cr(SO_4)_2$, $Cr(NO)_3$-$9H_2O$ or $KCr(SO_4)_2$ and any mixtures of these compounds. A preferred trivalent chromium salt concentration is within the range of about 5.0 to 7.0 grams per liter of the aqueous solution. It has been found that particularly good results are obtained from these processes when the trivalent chromium compound is present in solution in the preferred ranges.

The acidic solutions may contain at least one divalent zinc compound to provide color and also improve the corrosion protection of the metal when compared to other treatments or compositions that do not contain zinc. The amount of the zinc compounds can be varied up to the solubility limits to adjust the color imparted to the coating, ranging from 0.0 to 100 grams to as little as about 0.001 grams per liter up to 10 grams per liter e.g. 0.5 to 2.0 grams of $Zinc^2$+ cation. The divalent zinc can be supplied by any chemical compound e.g. salt that dissolves in water at the required concentration and is compatible with the other components in the acid solution. Divalent zinc compounds that are water soluble at the required concentrations preferably include, for example, zinc acetate, zinc telluride, zinc tetrafluoroborate, zinc molybdate, zinc hexafluorosilicate, zinc sulfate and the like or any combination thereof in any ratio. The treatment or coating of the metal substrates can be carried out at various temperatures including temperatures of the solution which ranges from ambient e.g. from about room temperature up to about 120° F. or higher up to about 200° F. Room temperature is preferred, however, in that this eliminates the necessity for heating equipment. The coating may be air dried by any of the methods known in the art including, for example, oven drying, forced-air drying, exposure to infra-red lamps, and the like.

The following Examples illustrate the stable acidic solutions of this invention, and the method of using the solutions in providing color recognition, improved adhesion bonding and corrosion-resistant coatings for metal substrates including metal substrates having a pre-existing metal coating.

EXAMPLE 1

To one liter of deionized water, add 4.0 grams of potassium hexafluorozirconate, 3.0 grams of chromium III sulfate basic, 0.12 grams potassium tetrafluoroborate, and 0.25 grams benzotriazole. Stir solution until all compounds are dissolved. Let stand at ambient conditions (70-80F) until pH reaches 3.70.

EXAMPLE 2

To one liter of deionized water, add 4.0 grams of potassium hexafluorozirconate, 3.0 grams of chromium III sulfate basic, 2.3 grams glycerol (0.025 moles), and 0.25 grams benzotriazole. Stir solution until all compounds are dissolved. Let stand at ambient conditions (70-80F) until pH reaches 3.55.

EXAMPLE 3

To one liter of deionized water, add 4.0 grams of potassium hexafluorozirconate and 3.0 grams of chromium III sulfate basic. Stir solution until all compounds are dissolved. Maintain pH between 3.25 and 3.50 for 14 days with dilute sulfuric acid and dilute potassium hydroxide and then adjust to final pH of 3.90. Add 0.25 grams benzotriazole.

EXAMPLE 4

Prepare solution as in Example 2, except replace the benzotriazole with 0.50 grams of 2-mercaptobenzimidazole.

EXAMPLE 5

Prepare solution as in Example 3, except add 0.25 grams of 2-mercaptobenzimidazole in addition to the benzotriazole.

EXAMPLE 6

Prepare solution as in Example 1, except add 0.25 grams 2-mercaptobenzimidazole and 0.25 grams 2-mercaptobenzazole in addition to the benzotriazole.

EXAMPLE 7

The compositions of Examples 1, 2 and 3 were used to coat the aluminum alloy (2024-T3) panels as follows:

The process comprises cleaning 3 inch by 5 inch by 0.030 inch (2024 -T3) panels in Turco 425 at 140° F. for 15 minutes. Rinse in warm tap water using cascading double backflow. Immediately, immerse coupons in Turco Smut Go for 5 minutes. Rinse in ambient temperature tap water using cascading double backflow. Immediately, immerse the panels in the compositions of Examples 1, 2 and 3 for five (5) minutes at 70-80° F. Rinse in ambient temperature tap water using cascading double backflow. Final rinse with deionized water. Let the panels air dry and stand overnight. Coatings are ready for testing or subsequent coating with an organic finish coating e.g. (MIL-PRF-23377) epoxy primer.

EXAMPLE 8

Figure 2:
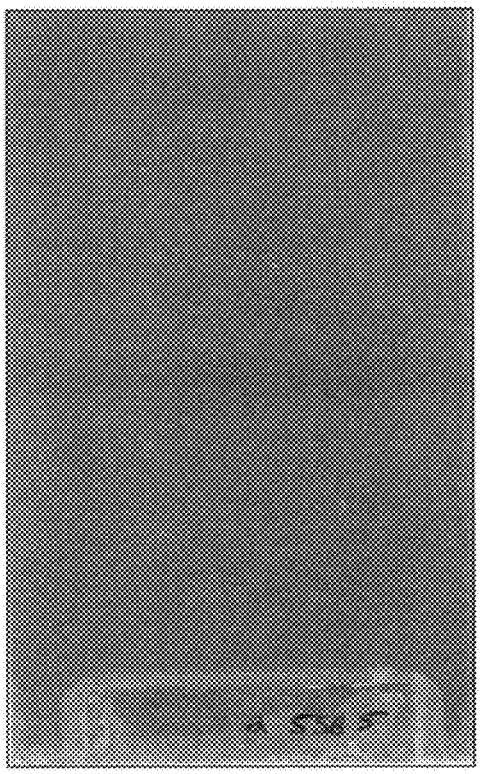
FIG. 2 (photo) shows the corrosion performance of the aluminum alloy (2024-T3) panel with a conversion coating derived from the composition of Example 1 with the benzotriazole inhibitor.
Figure 3:
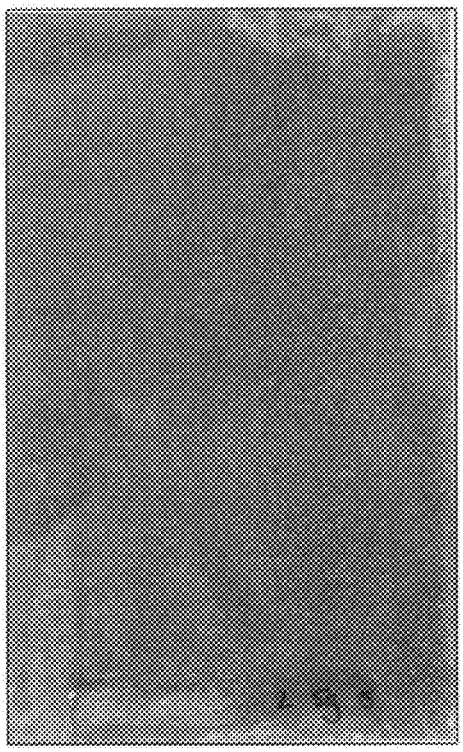
FIG. 3 (photo) shows the corrosion performance of the aluminum alloy (2024-T3) panel with a conversion coating derived from the composition of Example 2 without the triazole inhibitor.
Figure 4:
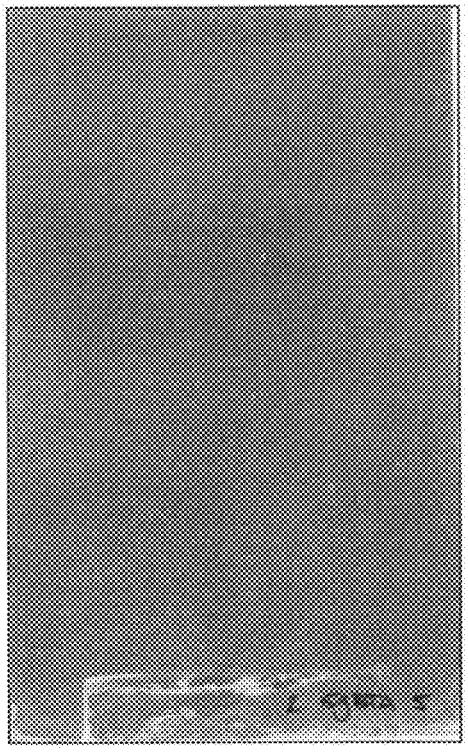
FIG. 4 (photo) shows the corrosion performance of the aluminum alloy (2024-T3) panel with a conversion coating derived from the composition of Example 2 with the benzotriazole inhibitor.
Figure 5:
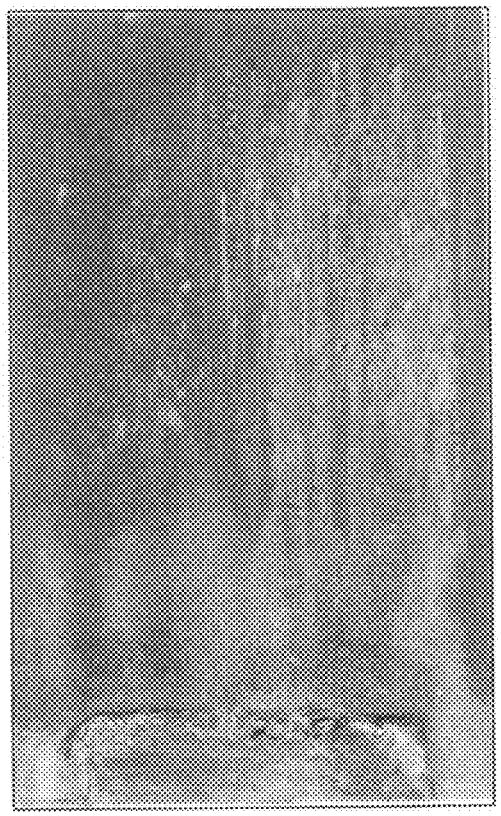
FIG. 5 (photo) shows the corrosion performance of the aluminum alloy (2024-T3) panel with a conversion coating derived from the composition of Example 3 without the triazole inhibitor.
Figure 6:
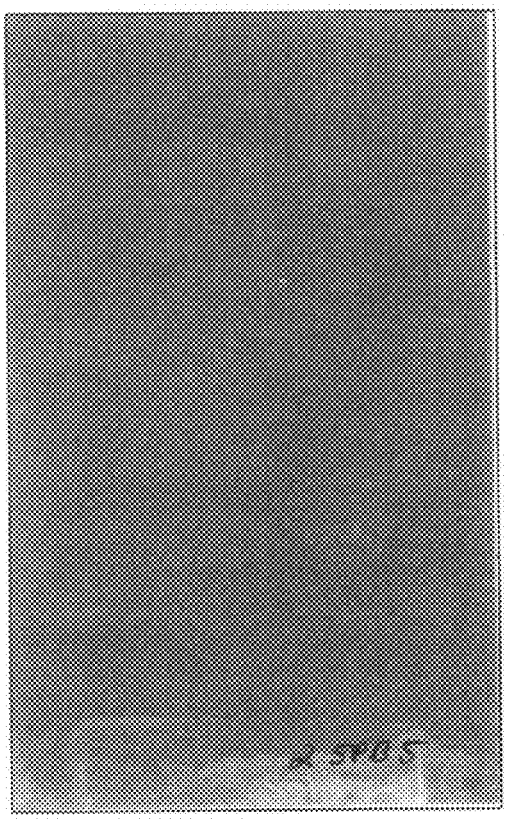
FIG. 6 (photo) shows the corrosion performance of the aluminum alloy (2024-T3) panel with a coating derived from the composition of Example 3 with the benzotriazole inhibitor.

Test panels were cleaned and coated by the process set forth in Example 7 then placed in neutral salt fog (ASTM B117) at an incline of 6 degrees from vertical. After 3 weeks (21 days) in salt fog, the coating performance is shown in FIGS. 1-6. Control coatings were made from the compositions of Examples 1, 2 and 3 without the addition of the triazole pitting inhibitors. It is evident from comparing FIGS. 1-6 (photos) that the addition of the pitting inhibitors resulted in a positive effect on the corrosion resistance of the coatings made from the different compositions.

The anti-pitting or corrosion inhibitors are water-soluble compounds selected from the group consisting of triazoles, benzimidazoles, benzazoles, benzoxazoles and mixtures of these inhibitors in any ratio. The preferred corrosion inhibitors or anti-pitting compounds include the triazoles containing up to 12 carbon atoms, such as the alkyl and preferably the aryl triazoles. The aryl triazoles contain from 6-10 carbon atoms, including compounds such as benzotriazole and tolyltriazole, and the alkyl triazoles containing up to six carbons such as methyl or ethyl triazole. The triazoles such as benzotriazole are commercially available under the trade name COBRATEC. The anti-pitting inhibitors are dissolved in the solutions in an effective amount sufficient to inhibit corrosion, and preferably in amounts ranging from about 0.001 to 4.0 grams per liter, and more preferably in amounts of 0.25 to 2.0 grams or from about 0.25 to 1.0 grams per liter. Other useful triazoles include the water soluble hydroxybenzotriazole, such as hydroxy-4 -alkylbenzotriazoles, hydroxy-6-benzotriazole, hydroxy-5-chlorobenzotriazole, hydroxy-6-carboxybenzotriazole, hydroxy-5-alkylbenzotriazoles and the like.

The stabilizing carboxylic compounds added to the acidic aqueous solutions include water-soluble acids and/or carboxylic acid salts, including the water-soluble carboxylic acids and salts such as adipic, citric, acetic, citraconic, fumaric, glutaric, tartaric acids, or ethylenediamine tetraacetic acid provided the hydrocarbon chain on the carboxylic group does not contain a significant number of carbons which decrease the compounds degree of solubility. Combinations of two or more of the salts and/or acids can be used to obtain a specific pH. For example, the lower molecular acids and/or salts such as potassium formate or citrate can be used at concentrations of at least 0.001 to 2.0 moles or 0.001 to 1.0 mole per liter. These compounds are good all-around stabilizers. Particularly good results were obtained from acidic solutions prepared by adding about 0.01 mole per liter of potassium formate after 4 days of the initial solution preparation. Good results are obtained if the stabilizing agents are carboxylic compounds containing both hydroxy and carboxylic groups including, for example, compounds such as citric acid, glycolic acid, lactic acid, gluconic acids, glutaric acid and their salts.

In addition to the carboxylic compounds as stabilizing agents for the solutions, small but effective amount of polyhydroxy compounds also can be used as stabilizers in amounts ranging from about 0.001 to 2.0 and preferably from 0.01 to 2.0 moles or 0.01 to 1.0 mole per liter. The compounds include the trihydric compounds e.g. glycerol and the dihydric ether alcohols e.g. glycol ethers including alkylene glycol ethers, such as triethylene glycol ether, propylene glycol ether, tripropyleneglycol ether, or diethyleneglycol ether. Other glycols include some of the lower molecular weight compounds such as ethylene glycol, propylene glycol, butylene glycol, cyclohexanol, and the water-soluble poly (oxyalkylene glycols) e.g. the poly-(oxyethylene) or poly-(oxypropylene glycols), having lower molecular weights ranging up to about 1000 may be employed to promote stability and dispersibility of solids in the coating bath or acid solutions. Other known di- and trihydric aliphatic alcohols include the water soluble lower alkanols, such as the di- and tri-hydric alkanols containing up to twelve carbon atoms. This class of di- and trihydric lower alkanols can include glycols containing up to ten carbon atoms in the alkylene group e.g. triethylene glycol, and the polyglycols, such as diethylene glycol, triethylene glycol, tetraethylene glycol, dipropylene glycol, tripropylene glycol, dibutylene glycol, tributylene glycol, and other polyalkylene glycols wherein the alkylene radical contains up to eight carbon atoms and preferably from two to four carbon atoms. Combinations or mixtures of the carboxylic and polyhydroxy stabilizing compounds may be used in the acidic solution in any ratio. In addition to the polyhydroxy and carboxylic stabilizing compounds, the acidic aqueous solutions may contain small but effective amounts of from 0.0 to 24 grams e.g. 0.01 to 12 grams per liter of solution of at least one fluorometallic compound preferably including stabilizing compounds such as hexafluorotitanate, heptafluorotantalate, tetrafluoroborate and hexafluorosilicate.

In preparing the acidic solutions of this invention, known water soluble surfactants can be added to the trivalent chromium solutions in amounts ranging from about 0 to 20 grams per liter and preferably about 5.0 to 10 grams or 1.0 to 5.0 grams per liter. The surfactants are added to the aqueous solution to provide better wetting properties by lowering the surface tension thereby insuring complete coverage, and a more uniform film on the metal substrates. The surfactants include at least one water soluble compound selected from the group consisting of non-ionic, anionic, and cationic surfactants. Some of the better known water soluble surfactants include the monocarboxyl imidoazoline, alkylsulfate sodium salts (DUPONOL®), ethoxylated or propoxylated alkylphenol (IGEPAL®), alkylsulfonamides, alkaryl sulfonates, palmiticalkanol amides (CENTROL®), octylphenyl polyethoxy ethanol (TRITON®, sorbitan monopalmitate (SPAN®), dodecylphenyl polyethyleneglycol ether (TERGITROL®), alkyl pyrrolidones, polyalkoxylated fatty acid esters, alkylbenzene sulfonates and mixtures thereof. Other known water soluble surfactants include, for example, the nonylphenol ethoxylates, and adducts of ethylene oxide with fatty amines; see the publication: "Surfactants and Detersive Systems", by John Wiley et al. in Kirk-Othmer's Encyclopedia of Chemical Technology, 3$^{rd}$ Ed.

When large surfaces do not permit immersion or where vertical surfaces are to be sprayed, thickening agents can be added to retain the aqueous solution on the surface for sufficient contact time. The thickeners employed are known inorganic and preferably the organic water soluble thickeners added to the trivalent chromium solutions in effective amounts e.g. at sufficient concentrations ranging from about 0 to 20 grams per liter and preferably 0.5 to 10 grams or 1.0 to 5.0 grams per liter of the acidic solution. Specific examples of some preferred thickeners include the cellulose compounds, e.g. hydroxypropyl cellulose (Klucel), ethyl cellulose, hydroxyethyl cellulose, hydroxymethyl cellulose, methyl cellulose and mixtures thereof. Other water soluble inorganic thickeners include colloidal silica, clays such as bentonite, starches, gum arabic, tragacanth, agar and various combinations.

After preparing the metal substrate surface to be coated via conventional techniques, the solution can be applied via immersion, spray or wipe-on techniques. The TCP solutions of this invention can be used at elevated temperatures ranging up to 120° F. or higher e.g. up to 200° F. and optimally applied via immersion to further improve the corrosion resistance of the coatings. Solution dwell time ranges from about 1 to 60 minutes, and preferably 1.0 to 40 or 1.0 to 10 minutes at about 75° F. or higher. After dwelling, the remaining solution is then thoroughly rinsed from the substrate with tap or deionized water. No additional chemical manipulations of the deposited films are necessary for excellent performance. The aqueous solutions may be sprayed from a spray tank apparatus designed to replace immersion tanks.

While this invention has been described by a number of specific examples, it is obvious that there are other variations and modifications which can be made without departing from the spirit and scope of the invention as particularly set forth in the appended claims.

The invention claimed:

1. Compositions for coating metal substrates to improve the corrosion protection and adhesion bonding strength of said metal which comprise an acidic aqueous solution having a pH ranging from about 1.0 to 5.5 and per liter of said solution from about 0.01 to 100 grams of at least one trivalent chromium compound, from about 0.01 to 24 grams of at least one fluorozirconate, an effective amount of at least one water-soluble corrosion inhibitor selected from the group consisting of triazoles, benzimidazoles, benzazoles, benzoxazoles and mixtures of said inhibitors, from about 0.0 to 20 grams of divalent zinc compounds, from about 0.0 to 20 grams of surfactants, from about 0.0 to 20 grams of thickeners, and effective amount of a stabilizing compound selected from the group consisting of polyhydroxy compounds, carboxylic compounds and mixtures of polyhydroxy and carboxylic compounds, wherein the carboxylic compound is a hydroxyl-carboxylic acid and the water soluble salts thereof, wherein the hydroxyl-carboxylic acid compound is glycolic acid and the water soluble salts thereof.

2. Compositions for coating metal substrates to improve the corrosion protection and adhesion bonding strength of said metal which comprise an acidic aqueous solution having a pH ranging from about 1.0 to 5.5 and per liter of said solution from about 0.01 to 100 grams of at least one trivalent chromium compound, from about 0.01 to 24 grams of at least one fluorozirconate, an effective amount of at least one water-soluble corrosion inhibitor selected from the group consisting of triazoles, benzimidazoles, benzazoles, benzoxazoles and mixtures of said inhibitors, from about 0.0 to 20 grams of divalent zinc compounds, from about 0.0 to 20 grams of surfactants, from about 0.0 to 20 grams of thickeners, and effective amounts of a stabilizing compound selected from the group consisting of polyhydroxy compounds, carboxylic compounds and mixtures of polyhydroxy and carboxylic compounds, wherein the carboxylic compound is a hydroxyl-carboxylic acid and the water soluble salts thereof, wherein the hydroxyl-carboxylic acid compound is lactic acid and the water soluble salts thereof.

* * * * *